US008778090B2

(12) United States Patent
Fuglein et al.

(10) Patent No.: US 8,778,090 B2
(45) Date of Patent: Jul. 15, 2014

(54) METHOD FOR OPERATING A DISHWASHER

(75) Inventors: Stefan Fuglein, Nuremberg (DE); Klaus-Martin Forst, Peterswoerth (DE); Hansjorg Lampe, Nuremberg (DE)

(73) Assignee: Electrolux Home Products Corporation N.V., Brussels (BE)

( * ) Notice: Subject to any disclaimer, the term of this patent is extended or adjusted under 35 U.S.C. 154(b) by 224 days.

(21) Appl. No.: 13/265,113

(22) PCT Filed: Apr. 26, 2010

(86) PCT No.: PCT/EP2010/002554

§ 371 (c)(1), (2), (4) Date: Oct. 18, 2011

(87) PCT Pub. No.: WO2010/121836

PCT Pub. Date: Oct. 28, 2010

(65) Prior Publication Data

US 2012/0037187 A1 Feb. 16, 2012

(30) Foreign Application Priority Data

Apr. 24, 2009 (EP) ..... 09005742

(51) Int. Cl.
*B08B 7/04* (2006.01)

(52) U.S. Cl.
USPC ..... 134/18; 134/25.2

(58) Field of Classification Search
None
See application file for complete search history.

(56) References Cited

U.S. PATENT DOCUMENTS

| | | | |
|---|---|---|---|
| 4,211,517 | A | 7/1980 | Schmid |
| 5,370,743 | A | 12/1994 | Usui et al. |
| 5,731,868 | A | 3/1998 | Okey et al. |
| 5,765,724 | A | 6/1998 | Amberg et al. |
| 2005/0174123 | A1 | 8/2005 | Ott |

FOREIGN PATENT DOCUMENTS

| | | | |
|---|---|---|---|
| DE | 19534431 | A1 | 3/1997 |
| DE | 102004002647 | A1 | 8/2005 |
| DE | 19650915 | B4 | 9/2006 |
| EP | 0117471 | B1 | 10/1987 |
| EP | 0 383 218 | A1 | 8/1990 |
| EP | 0383218 | A1 | 8/1990 |
| EP | 0 589 244 | A1 | 3/1994 |
| EP | 0589244 | A1 | 3/1994 |

(Continued)

OTHER PUBLICATIONS

English Machine Translation of EP 1707663 A1.*
English Machine Translation of WO 2008/034692 A1.*
International Search Report for Application No. PCT/EP2010/002554 dated Aug. 17, 2010.
European Patent Office, Extended European Search Report for European Application No. 09005742.3, dated Oct. 7, 2009, 7 pages, Germany.

(Continued)

*Primary Examiner* — Nicole Blan
(74) *Attorney, Agent, or Firm* — Alston & Bird LLP

(57) ABSTRACT

A method to operate a dishwasher, comprising: (1) adding detergent to a cleaning liquid which is circulated within the dishwasher; (2) measuring the conductivity of the cleaning liquid and determining the rate of change in conductivity caused by dissolution of the detergent in the cleaning liquid; (3) comparing the rate of change in conductivity with a predetermined threshold value so as to determine the dissolution rate of the detergent that has been added in step (A) to the cleaning liquid; and (4) adjusting operating parameters based on the determination of step (C).

20 Claims, 2 Drawing Sheets

(56) References Cited

FOREIGN PATENT DOCUMENTS

Figure 1:
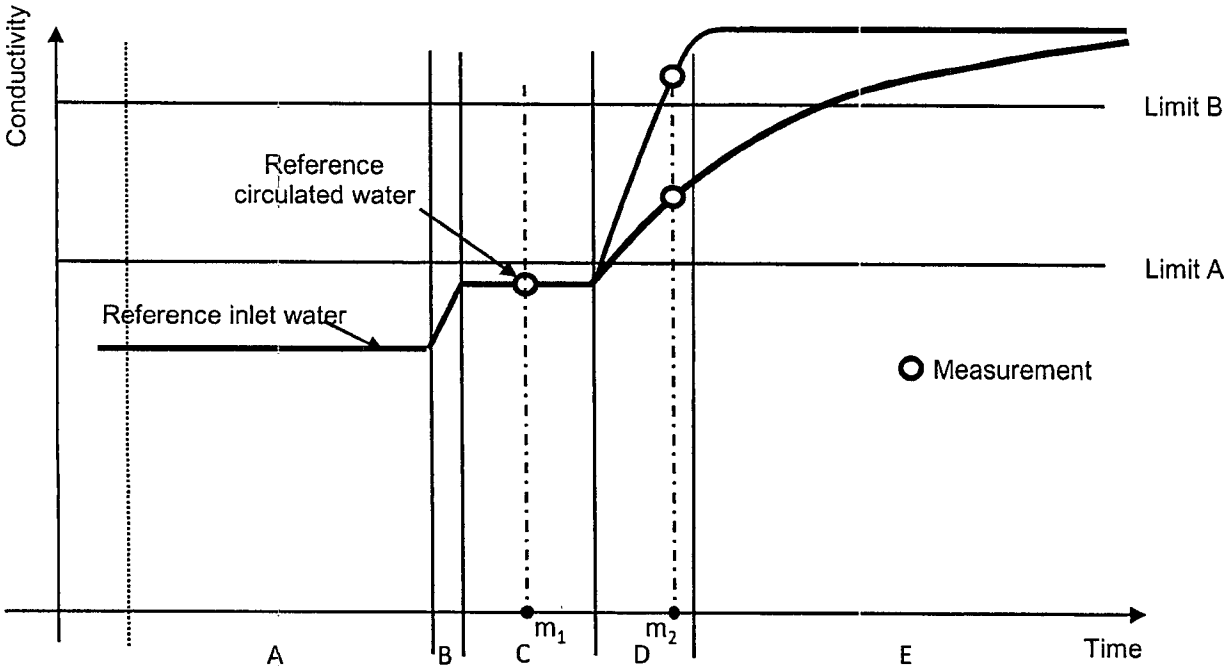

| | | | | |
|---|---|---|---|---|
| EP | 0686721 | B1 | | 5/2000 |
| EP | 1688529 | A1 | | 8/2006 |
| EP | 1 707 663 | A1 | | 10/2006 |
| EP | 1707663 | A1 | * | 10/2006 |
| GB | 2 266 898 | A | | 11/1993 |
| GB | 2266898 | A | | 11/1993 |
| WO | WO 00/27703 | A1 | | 5/2000 |
| WO | WO 2008034692 | A1 | * | 3/2008 |

OTHER PUBLICATIONS

European Patent Office, Extended European Search Report for European Application No. 12174795.0, dated Sep. 11, 2012, 5 pages, Germany.

* cited by examiner

METHOD FOR OPERATING A DISHWASHER

CROSS REFERENCE TO RELATED APPLICATIONS

This application is a national stage application filed under 35 U.S.C. 371 of International Application No. PCT/EP2010/002554, filed Apr. 26, 2010, which claims priority from European Application No. 09005742.3, filed Apr. 24, 2009, each of which is incorporated herein in its entirety.

The present invention relates to a method for operating a dishwasher.

In modern dishwashers increasing effort is undertaken to provide for automatic selection and adaptation of operating parameters of the washing program with which the dishwasher is to be operated, so as to optimise such washing program in terms of efficiency, cleaning result, power consumption, water consumption, duration and the like.

To this end, modern dishwashers can be equipped with a number of sensors, which determine certain conditions prevailing within the dishwasher, so as to gain information with respect to parameters that may vary from washing cycle to washing cycle, such as the type, amount and degree of soiling of the articles that are loaded into the dishwasher, or characteristics of the cleaning liquid circulated within the dishwasher, such as the temperature, water hardness, detergent concentration and the like.

One type of sensor, which has been used in washing machines or dishwashers is a conductivity sensor, i.e. a sensor which is adapted to measure the electrical conductivity of the cleaning liquid that is circulated within the dishwasher.

In most prior uses of a conductivity sensor in a dishwasher or washing machine, the conductivity sensor was used to determine the detergent concentration, so as to maintain a constant supply or concentration of detergent. Thus, for example, in DE-A-10 2004 002 647 it is suggested to provide a washing machine or a dishwasher with a conductivity sensor that may be used to determine the detergent concentration, so as to adjust the dosing of the detergent.

Similarly, in WO-A-00/27703 there is suggested a detergent dispenser for a commercial dishwasher, wherein the detergent dispenser comprises a conductivity sensor for measuring the detergent concentration of the cleaning liquid, and wherein the detergent dispenser is designed so as to supply additional detergent in case that the conductivity sensor detects that the detergent concentration has fallen below a certain level.

A similar arrangement is suggested in U.S. Pat. No. 4,211,517 in which a commercial dishwasher is suggested which is equipped with a conductivity sensor that measures the pH-level in the sump of the dishwasher, so as to maintain a desired constant supply of detergent.

Furthermore, in EP-B-0 117 471 there is disclosed a washing machine or dishwasher which comprises a conductivity sensor for detecting the detergent concentration and which is designed such, that if the detergent concentration falls below a certain level, more detergent is supplied, so as to provide for a substantially constant detergent concentration within the cleaning liquid that is circulated through the machine.

In U.S. Pat. No. 5,765,724 there is disclosed a dispenser for detergent in paste form, wherein a conductivity sensor measures the detergent concentration, so as to create a warning signal, should the detergent concentration fall below a certain level, so that the user is informed that the detergent paste has been spent and new detergent should be added.

Apart from using conductivity sensors for measuring detergent concentration, in EP-A-1 688 529 there suggested a washing machine which is equipped with a conductivity sensor located in the water circulation pipe downstream of a detergent container. Here, the washing machine is designed to measure the conductivity of the cleaning liquid during flushing of the detergent container. If the measuring signal generated by the conductivity sensor no longer changes, it is assumed that the detergent has been completely flushed out of the detergent container and the water supply through the detergent container is terminated.

In DE-A-195 34 431 there is disclosed a washing machine, that is equipped with a conductivity sensor, which is used to detect the degree of soiling of the washing load. To this end, the conductivity sensor measures the change in conductivity during soaking of the washing load, i.e. before addition of detergent. By comparison of measurements made at the beginning and at the end of the soaking step the degree of soiling is determined, so as to adjust the amount of detergent to be added in a subsequent washing step.

Furthermore, from EP-B-0 686 721 there is known a washing machine, in which the motor driving the washing drum initially is operated at varying speeds and during doing so the load on the motor is detected, so as to determine the amount of clothing which has been loaded into the drum. Additionally, a conductivity sensor is used to determine the water quality during rinsing the drum, wherein based on such determination the amount of water to be used in a subsequent rinsing step is selected.

Finally, the method for operating a dishwasher described in DE-B-196 50 915 makes use of the fact that detergents of different chemical composition, such as enzyme containing detergents and alkaline detergents, result in a different conductivity of the cleaning liquid to which such detergent is added. In the method described in DE-B-196 50 915 the conductivity of the cleaning liquid is measured after the detergent has been added thereto, so as to obtain an absolute conductivity value, based on which the type of detergent is determined and corresponding process steps of the washing program are initiated. While the method suggested in DE-B-196 50 915 allows to discern between detergents of different chemical composition, this method does not allow to differentiate between detergents which have a similar chemical composition but have a different physical composition, as is the case for example detergents for dishwashers which are available both in powder form and in tablet form.

It is an object of the present invention to provide for a method for operating a dishwasher, which allows for further adaptation and thus optimization of the washing program, and particularly for a method for operating a dishwasher which provides for an optimum dissolution of the detergent that has been added to the cleaning liquid.

In accordance with the present invention this object is solved by the method for operating a dishwasher, as it is defined in present claim 1.

In contrast to the prior art methods, in which the conductivity of the cleaning liquid was measured in order to either provide for an indication whether a certain concentration of detergent is contained in the cleaning liquid, so as to control either the addition of detergent to the cleaning liquid or to adjust the duration or amount of water feed used in the rinsing steps, in the method in accordance with the present invention, a conductivity sensor is used to detect how fast the detergent is dissolving, so as to adjust the washing program based on such determination. Such determination is of particular advantage in dishwashers, since it allows to detect whether a fast dissolving or a slow dissolving detergent, such as a detergent in powder form or a detergent in tablet form, has been added to the dishwasher, which was not possible to decide in the heretofore known methods and systems. Thus, particularly when employing multicomponent detergent tablets, such as the so-called 3-in-1, 4-in-1, 5-in-1 etc. detergents, in which different types of agents, such as a detergent, a glass protection agent, a rinsing aid, salt components, cutlery treating agents and the like, are compacted into a single tablet. Since the individual components of the detergent tablet shall come into effect at different times of the washing cycle, these tablets are designed to dissolve much more slowly than a detergent that is provided into the dishwasher in powder form and thus requires a completely different set of operating parameters of the washing cycle to provide for optimum efficiency of the washing cycle.

Preferred embodiments of the present invention are defined in the dependent claims.

In accordance with a preferred embodiment, prior to step (A), that is prior to adding detergent to the cleaning liquid, the conductivity of the cleaning liquid is measured, so as to obtain a reference value, which reference value is applied in the determination of step (B), i.e. in the determination of the rate of change in conductivity which is caused by the dissolution of the detergent in the cleaning liquid. By applying such reference value, the determination of step (B) becomes more reliable, since it thus takes into account any changes in conductivity of the cleaning liquid that are caused already before addition of the detergent, such as changes in conductivity which are caused by soil particles or detergent residues, which are present in the dishwasher from a previous washing cycle or which originate from the articles that were loaded into the dishwasher.

Preferably the method further comprises determining a conductivity reference value which is representative for the conductivity of the fresh water supplied to the dishwasher, which fresh water conductivity reference value then is used in the determination of step (B). By applying in step (B) such fresh water conductivity reference value, the determination of the change in conductivity which is caused by the dissolution of the detergent takes into account any changes in conductivity which may be caused by variations in the conductivity of the fresh water supplied into the dishwasher.

The fresh water conductivity reference value may also be preset in the operating program of the dishwasher. That is, rather than measuring the conductivity of the fresh water every time a new washing cycle is started, the fresh water conductivity reference value thus can be permanently set by the user in the operating program of the dishwasher, taking into account that although there can be regional differences in the conductivity of the fresh water, the conductivity of the fresh water at a specific location usually more or less is constant and thus generally can be preset in the operating program of the dishwasher with sufficient accuracy, upon installation of the dishwater at a certain location.

In accordance with a preferred embodiment of the method suggested herein, in step (B) the conductivity of the cleaning liquid is measured more than once, so as to provide for a higher accuracy and thus reliability of the measurement.

In step (B) of the present method, the change in conductivity can be recorded as a function of time, wherein the slope of this function then can be determined in step (B) and, in step (C); can be compared with a predetermined threshold slope.

Additionally or alternatively an absolute conductivity value can be measured and compared with one or more threshold values, so as to determine the rate of dissolution of the detergent.

A more precise adaptation of the washing program to the dissolution speed of the detergent can be provided for, when there are provided a plurality of predetermined threshold values and wherein in step (C) the rate of change in conductivity is assigned to one of a plurality of ranges that are limited by said predetermined threshold values. In this manner not only a distinction can be made between detergent in powder-form and detergent in tablet-form per se, but rather also within such classes of detergents a distinction can be made between a slower and a faster dissolving detergent such as between different types of detergent tablets.

Based on the determination made in step (C), the parameters that are adjusted in step (D) can be operating parameters of the pre-wash phase, the main wash phase and/or an intermediate wash-phase. Thus, for example, if it is detected in step (C), that a detergent in powder-form has been added to the cleaning liquid, the prewash-phase can be shortened or even omitted, so as not to spend the detergent in the prewash-phase, but rather to save the detergent for the main wash phase.

The parameters which are adjusted in step (D) based on the determination of the dissolution velocity of the detergent can be any operating parameters of the washing program, such as the selection of individual program steps, the duration of individual program steps, the timing of individual program steps, the temperature of the cleaning liquid which is circulated within the dishwasher, the air temperature within the dishwasher which apart from the temperature of the cleaning liquid can be adjusted by additional heating elements, such as an electric heating elements providing in or near the washing compartment, the amount of fresh water which is fed into the dishwasher, the speed of the circulation pump, i.e. the timing, when, how long and how fast such pump is driven, and similarly the speed of the drain pump and the like.

In order to provide for optimum usage of the detergent added in step (A), the method can be designed such that if in step (C) it is determined that the dissolution rate is below said predetermined threshold value, in step (D) a longer program duration is selected for the washing step in which the detergent added in step (A) is to be used. Preferably, if in step (D) a longer program duration is selected, the heating in said washing step is delayed, so as to provide for intervals with substantially constant temperature. When designing the method in this manner, the washing program takes into account that the detergent needs more time to completely dissolve and to be circulated for a sufficient duration within the washing compartment of the dishwasher so as to provide for a satisfactory cleaning result. While it has been found, that there are certain temperature ranges that are optimum for the detergent to become fully and most effectively active, the heating preferably provides for intervals with substantially constant temperature. For example, for detergents containing enzymes, a temperature range of 40 to 45° C., and particularly of about 42° C., has proven to be most effective.

If in step (D) a longer program duration is selected, said prolongation can be at least partially compensated for by shortening subsequent program steps, by conducting individual program steps at a higher temperature and/or by conducting individual program steps with a higher speed of the circulation pump used for circulating the cleaning liquid within the dishwasher. In cases, where the duration of the washing program is of little relevance, for example, when the dishwasher is operated over night, such compensation can be omitted, so as to avoid any potential increase in energy or decrease in washing efficiency that may be caused by the aforementioned measures.

As mentioned above, the method suggested herein can be used to determine in step (C), whether a detergent in powder form or a detergent tablet has been added in step (A). In such an embodiment the method further can comprise predetermining an average detergent tablet dissolution duration, as it is generally required for dissolution of a detergent table in the cleaning liquid. In step (B) the rate of change in conductivity then is determined by measuring the conductivity of the cleaning liquid at a time after addition of the detergent which is shorter than the average detergent tablet dissolution duration.

Furthermore, an average detergent powder dissolution duration can be determined, as it is generally required for dissolution of a detergent-powder in the cleaning liquid, wherein in step (B) the rate of change in conductivity then can be determined by measuring the conductivity of the cleaning liquid at a time after addition of the detergent, which is shorter than said average detergent tablet dissolution duration, but which is longer than said average detergent powder dissolution duration. By thus selecting a point in time for measuring the conductivity of the cleaning liquid, at which, if a cleaning detergent in powder-form is supplied, such detergent should be fully dissolved, but at which point in time a detergent tablet would only be partially dissolved, a reliable distinction can be made, whether a detergent in powder-form or a detergent tablet has been added.

Alternatively, an average detergent powder dissolution duration required for dissolution of a detergent powder in the cleaning liquid is predetermined, and in step (B) the rate of change in conductivity is determined by measuring the conductivity of the cleaning liquid at a time after addition of the detergent which is shorter than said average detergent powder dissolution duration. While at such a point in time neither a detergent in powder-form nor a detergent in tablet-form would be fully dissolved, due to the higher dissolution velocity of the detergent in powder form it nevertheless can be reliably distinguished, whether a detergent in powder-form or a detergent in tablet-form has been added.

Figure 2:
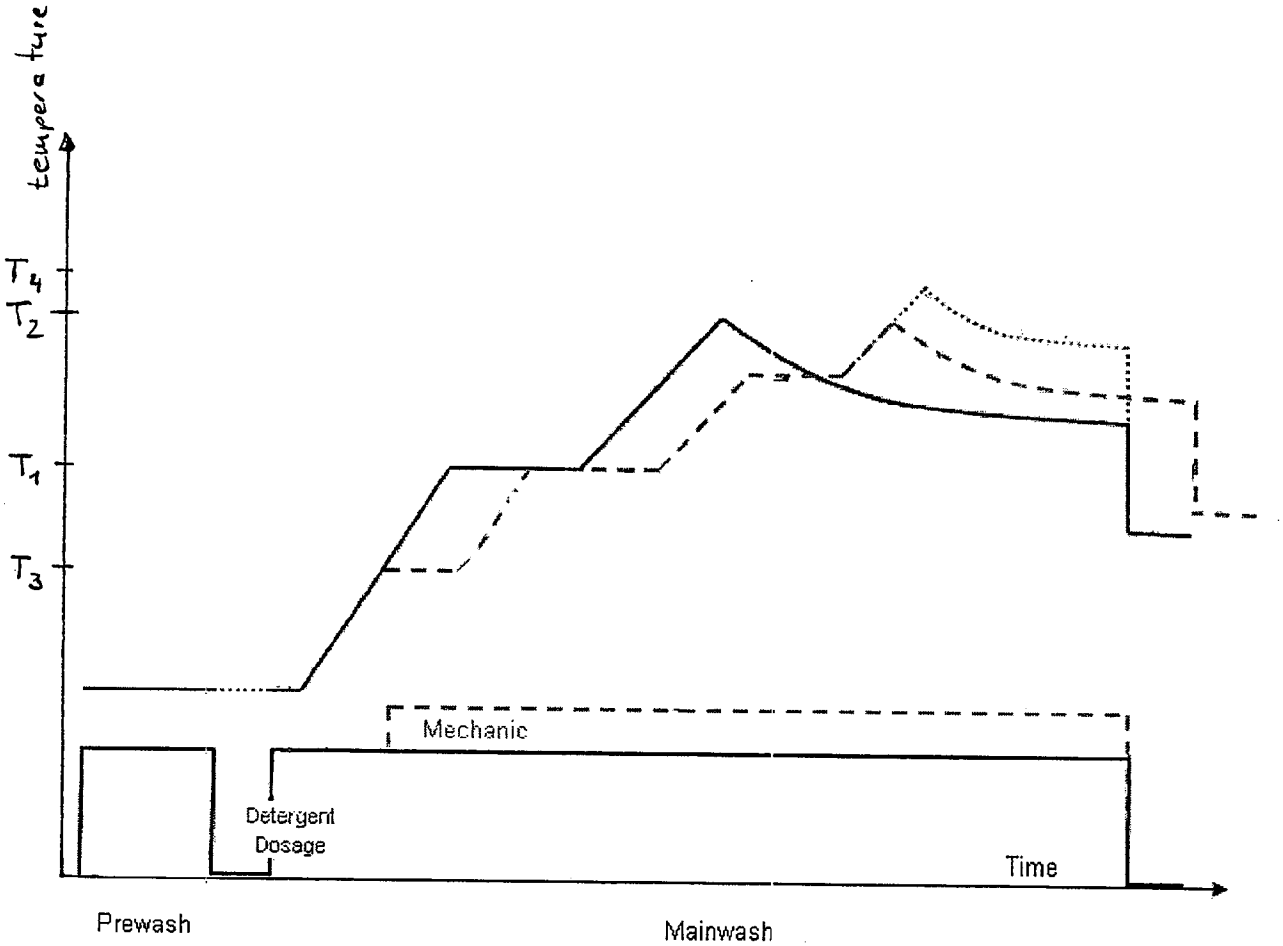

Preferred embodiments of the present invention are described in further detail by reference to the attached drawings, in which FIG. 1 shows a diagram illustrating the determination of the dissolution velocity in accordance with the present invention; and FIG. 2 shows an example of the operation of a dishwasher in accordance with the method suggested herein.

FIG. 1 shows a diagram indicating conductivity over time during the first portion of a washing phase. At the beginning of such washing phase, which could be the main washing phase of a washing cycle comprising such main washing phase, optionally a prewash-phase, and one or more rinse phases as well as a drying phase, in stage A the water inlet is opened and fresh water is fed into the sump of the dishwasher. During such filling stage the conductivity of the fresh water can be measured so as to obtain a freshwater conductivity reference value or, alternatively, a freshwater conductivity reference value may be preset in the operating program of the dishwasher.

When in stage B the circulation of the water fed into the dishwasher is initiated, such as is done in a stage for wetting or prewashing the articles loaded into the dishwasher, residues, which may be present on the walls of the washing compartment, on the dishwasher internals such as on the surfaces of the dishwasher baskets, within the circulation, i.e. within the spray arms, the water feed lines, or the filters provided within the sump of the dishwasher and, of course, on the articles to be cleaned itself, are taken up into the cleaning liquid and thus can cause a change in conductivity, which in FIG. 1 is shown as an increase in conductivity.

In order to obtain a reference value for the conductivity of the cleaning liquid before the addition of detergent, a reference measurement is made at a point in time $m_1$ during stage C, i.e. during circulating the cleaning liquid through the dishwasher before initiating the addition of detergent, but after lapse of a certain amount of time (corresponding in FIG. 1 to stage B) that is required to obtain a substantially constant conductivity value of the cleaning liquid upon starting circulation thereof.

In stage D detergent is added to the cleaning liquid, such as by flushing a detergent container, which can be designed as a detergent compartment, which is closed with a movable lid, which lid at the beginning of stage D is opened. At a certain predetermined time after initiating the addition of the detergent, which point in time in FIG. 1 is denoted as $m_2$, the conductivity of the cleaning liquid is measured and is compared with at least one, and preferably with a plurality, of predetermined thresholds.

In FIG. 1 there is shown a lower conductivity limit A and an upper conductivity limit B. If during comparing the conductivity value measured at time $m_2$ with threshold levels A and B, it is determined that the measured conductivity is above limit B, it is determined that a fast-dissolving detergent has been added to the cleaning liquid, such as a detergent in powder-form. If however, the conductivity value measured at time $m_2$ is above limit A, but does not exceed limit B, it is determined that the detergent added to the cleaning liquid is a slowly dissolving detergent, such as a detergent in tablet-form. Should the conductivity that is measured at time $m_2$ be also below limit A, this is taken as an indication that no detergent has been added.

In dependency of such determination the operating program selects and adjusts the subsequent stages of the washing cycle. Should for example it be determined that no detergent has been added, a warning message can be given, such as an optical indication, which informs the user of the dishwasher, that no detergent has been detected in the cleaning liquid and adaptations of the washing cycle can be made.

An example of how the operation of the dishwasher can be modified in case that it is determined that a slowly dissolving detergent has been added, will be explained below by reference to FIG. 2. If a slowly dissolving detergent is detected, it generally will be desirable to select a longer washing program. Correspondingly, if a faster dissolving detergent is detected, it generally will be desirable to select a shorter washing program.

FIG. 2 shows an example of adjusting operating parameters of the washing program, and in particular of how the temperature within the washing compartment is adjusted. The curve in continuous line in FIG. 2 shows the temperature of the cleaning liquid which in an initial prewash phase is at a relatively low temperature, such as the temperature of the water feed line, which may be the domestic cold water line. During the main wash phase the cleaning liquid then is warmed until a temperature level $T_1$ is reached, for example, a temperature of 40 to 45° C. In the specific example shown in FIG. 2, the cleaning liquid first is held at this temperature and subsequently is heated to a higher temperature level $T_2$, wherein upon reaching the higher temperature $T_2$ the heating is shut-off, so that the temperature of the cleaning liquid again decreases during the time that the cleaning liquid is circulated within the dishwasher. When the main wash step is terminated, a drain pump is activated, so as to withdraw a part of or the entire cleaning liquid from the washing compartment.

FIG. 2 shows in dotted line a temperature profile that has been modified, when it has been detected that a slowly dissolving detergent has been used. As is shown in FIG. 2 in this case, the heating of the cleaning liquid is delayed so as to provide for intervals with substantially constant temperatures. In the embodiment illustrated in FIG. 2 by the dashed line curve, in addition to the constant temperature interval at temperature $T_1$ there is provided a further constant temperature interval at temperature $T_3$ which is lower than temperature $T_1$.

Due to the delay in heating of the cleaning liquid, the main wash step as such takes longer to achieve the same cleaning result than a washing program as shown in continuous line in FIG. 2. Such prolongation of the main wash step can be compensated by selecting a higher temperature $T_4$, to which the cleaning liquid is heated, as it is shown in FIG. 2 in dotted line, or by using a higher speed of the circulation pump, i.e. by using a higher water pressure of the water which is sprayed from the spray arms onto the articles to be cleaned.

Alternatively, a compensation of the prolongation of the main wash step could also be achieved by shortening subsequent steps such as the rinsing and/or drying steps.

The invention claimed is:

1. Method for operating a dishwasher, comprising the following consecutive steps:

(A) adding detergent to a cleaning liquid which is circulated within the dishwasher;

(B) measuring the conductivity of the cleaning liquid and determining the rate of change in conductivity caused by dissolution of the detergent in the cleaning liquid;

(C) comparing the rate of change in conductivity with a predetermined threshold value so as to determine the dissolution rate of the detergent that has been added in step (A) to the cleaning liquid; and (D) adjusting operating parameters based on the determination of step (C);

if in step (C) it is determined that the dissolution rate is below said predetermined threshold value, in step (D) a longer program duration is selected for the washing step in which the detergent added in step (A) is to be used; and if in step (D) a longer program duration is selected, heating in said washing step is delayed, so as to provide for intervals with substantially constant temperature.

2. The method of claim 1, wherein prior to step (A) the conductivity of the cleaning liquid is measured so as to obtain a reference value, which reference value is applied in the determination of step (B).

3. The method of claim 1, further comprising determining a conductivity reference value that is representative for the conductivity of fresh water supplied to the dishwasher and using said fresh water conductivity reference value in the determination of step (B).

4. The method of claim 3, wherein said fresh water conductivity reference value is preset in the operating program of the dishwasher.

5. The method of claim 1, wherein in step (B) the conductivity of the cleaning liquid is measured more than once.

6. The method of claim 1, wherein in step (B) the change in conductivity is recorded as a function of time, the slope of which is determined in step (B), and is compared in step (C) with a predetermined threshold slope.

7. The method of claim 1, wherein there are provided a plurality of predetermined threshold values and wherein in step (C) the rate of change in conductivity is assigned to one of a plurality of ranges that are limited by said predetermined threshold values.

8. The method of claim 1, wherein in step (D) operating parameters of a pre-wash phase, a main wash phase and/or an intermediate wash phase are adjusted.

9. The method of claim 1, wherein the parameters adjusted in step (D) are selected from:

the selection of individual program steps;

the duration of individual program steps;

the timing of individual program steps;

the temperature of the cleaning liquid circulated within the dishwasher;

the air temperature within the dishwasher;

the amount of fresh water fed into the dishwasher;

the speed of the circulation pump; and the speed of the drain pump.

10. The method of claim 1, wherein in step (C) it is determined whether a detergent in powder form or a detergent tablet has been added in step (A).

11. The method of claim 1, further comprising predetermining an average detergent tablet dissolution duration required for dissolution of a detergent tablet in the cleaning liquid, and wherein in step (B) the rate of change in conductivity is determined by measuring the conductivity of the cleaning liquid at a time after addition of the detergent which is shorter than said average detergent tablet dissolution duration.

12. The method of claim 11, further comprising predetermining an average detergent powder dissolution duration required for dissolution of a detergent powder in the cleaning liquid, and wherein in step (B) the rate of change in conductivity is determined by measuring the conductivity of the cleaning liquid at a time after addition of the detergent which is shorter than said average detergent tablet dissolution duration but is longer than said average detergent powder dissolution duration.

13. The method of claim 11, further comprising predetermining an average detergent powder dissolution duration required for dissolution of a detergent powder in the cleaning liquid, and wherein in step (B) the rate of change in conductivity is determined by measuring the conductivity of the cleaning liquid at a time after addition of the detergent which is shorter than said average detergent powder dissolution duration.

14. Method for operating a dishwasher, comprising the following consecutive steps:

(A) adding detergent to a cleaning liquid which is circulated within the dishwasher;

(B) measuring the conductivity of the cleaning liquid and determining the rate of change in conductivity caused by dissolution of the detergent in the cleaning liquid;

(C) comparing the rate of change in conductivity with a predetermined threshold value so as to determine the dissolution rate of the detergent that has been added in step (A) to the cleaning liquid; and (D) adjusting operating parameters based on the determination of step (C);

if in step (C) it is determined that the dissolution rate is below said predetermined threshold value, in step (D) a longer program duration is selected for the washing step in which the detergent added in step (A) is to be used; and if in step (D) a longer program duration is selected, said prolongation is at least partially compensated: by shortening subsequent program steps; by conducting individual program steps at a higher temperature; and/or by conducting individual program steps with a higher speed of a circulation pump used for circulating said cleaning liquid within the dishwasher.

15. The method of claim 14, wherein there are provided a plurality of predetermined threshold values and wherein in step (C) the rate of change in conductivity is assigned to one of a plurality of ranges that are limited by said predetermined threshold values.

16. The method of claim 14, wherein in step (D) operating parameters of a pre-wash phase, a main wash phase and/or an intermediate wash phase are adjusted.

17. The method of claim 14, wherein in step (C) it is determined whether a detergent in powder form or a detergent tablet has been added in step (A).

18. The method of claim 14, further comprising predetermining an average detergent tablet dissolution duration required for dissolution of a detergent tablet in the cleaning liquid, and wherein in step (B) the rate of change in conductivity is determined by measuring the conductivity of the cleaning liquid at a time after addition of the detergent which is shorter than said average detergent tablet dissolution duration.

19. The method of claim 18, further comprising predetermining an average detergent powder dissolution duration required for dissolution of a detergent powder in the cleaning liquid, and wherein in step (B) the rate of change in conductivity is determined by measuring the conductivity of the cleaning liquid at a time after addition of the detergent which is shorter than said average detergent tablet dissolution duration but is longer than said average detergent powder dissolution duration.

20. The method of claim 18, further comprising predetermining an average detergent powder dissolution duration required for dissolution of a detergent powder in the cleaning liquid, and wherein in step (B) the rate of change in conductivity is determined by measuring the conductivity of the cleaning liquid at a time after addition of the detergent which is shorter than said average detergent tablet dissolution duration.

* * * * *